US006236169B1

(12) United States Patent
Burtscher et al.

(10) Patent No.: US 6,236,169 B1
(45) Date of Patent: May 22, 2001

(54) SUPPLY CIRCUIT FOR A FLUORESCENT TUBE INSTALLATION

(75) Inventors: Heinz Burtscher, Zürich; Alfred Hug, Pfäffikon; Patrick Meier; Roman Moser, both of Windisch, all of (CH)

(73) Assignee: Amteca AG, Pfaffikon (CH)

( * ) Notice: Subject to any disclaimer, the term of this patent is extended or adjusted under 35 U.S.C. 154(b) by 0 days.

(21) Appl. No.: 09/529,058

(22) PCT Filed: Oct. 9, 1998

(86) PCT No.: PCT/CH98/00432

§ 371 Date: Jul. 5, 2000

§ 102(e) Date: Jul. 5, 2000

(87) PCT Pub. No.: WO99/20084

PCT Pub. Date: Apr. 22, 1999

(30) Foreign Application Priority Data

Oct. 10, 1997 (CH) ..... 2378/97

(51) Int. Cl.[7] ..... G05F 1/00

(52) U.S. Cl. ..... 315/291; 315/224; 315/289; 315/287; 315/DIG. 7

(58) Field of Search ..... 315/307, 209 R, 315/291, 287, 289, 246, 224, 244, DIG. 5, DIG. 7, 219, 225; 363/16, 41, 97, 134

(56) References Cited

U.S. PATENT DOCUMENTS

| | | | | |
|---|---|---|---|---|
| 4,535,399 | * | 8/1985 | Szepesi | 363/41 |
| 4,616,159 | * | 10/1986 | Ko et al. | 315/307 |
| 5,057,748 | * | 10/1991 | Doss | 315/224 |
| 5,150,014 | * | 9/1992 | Kastelein | 315/224 |
| 5,349,273 | * | 9/1994 | Pacholok | 315/307 |
| 5,371,440 | | 12/1994 | Liu et al. | 315/209 |
| 5,698,952 | * | 12/1997 | Stebbins | 315/307 |

FOREIGN PATENT DOCUMENTS

| | | |
|---|---|---|
| 3636901 A1 | 5/1988 | (DE) . |
| 0 439 861 A1 | 8/1991 | (EP) . |
| 0 599 598 A1 | 6/1994 | (EP) . |
| 2 547 128 | 12/1984 | (FR) . |
| 2 253 077 | 8/1992 | (GB) . |
| WO 96/31095 | 10/1996 | (WO) . |

OTHER PUBLICATIONS

Mu–Shen Lin et al., Primary–side dimming control driver for cold–cathode fluorescent lamps, Electronic Letters Jul. 18, 1996, vol. 32, No. 15, pp. 1334–1335.

* cited by examiner

*Primary Examiner*—Haissa Philogene
(74) *Attorney, Agent, or Firm*—Morgan, Lewis & Bockius LLP

(57) ABSTRACT

A supply circuit for a fluorescent tube installation with a high-voltage transformer (T) which is connected, input-end, to a supply voltage with a frequency of several hundred Hz, and which is formed without an air gap. To replace the air gap in the transformer, an electronic regulator (EST) is nonetheless used in the supply circuit, which emulates the current-limiting function of an air gap. The frequency of the supply voltage is between 300 and 800 Hz, preferably 400 Hz. As these frequencies are higher than the usual network frequency of 50/60 Hz, the size and weight of the transformer can be considerably reduced.

9 Claims, 2 Drawing Sheets

SUPPLY CIRCUIT FOR A FLUORESCENT TUBE INSTALLATION

TECHNICAL FIELD

Figure 1:
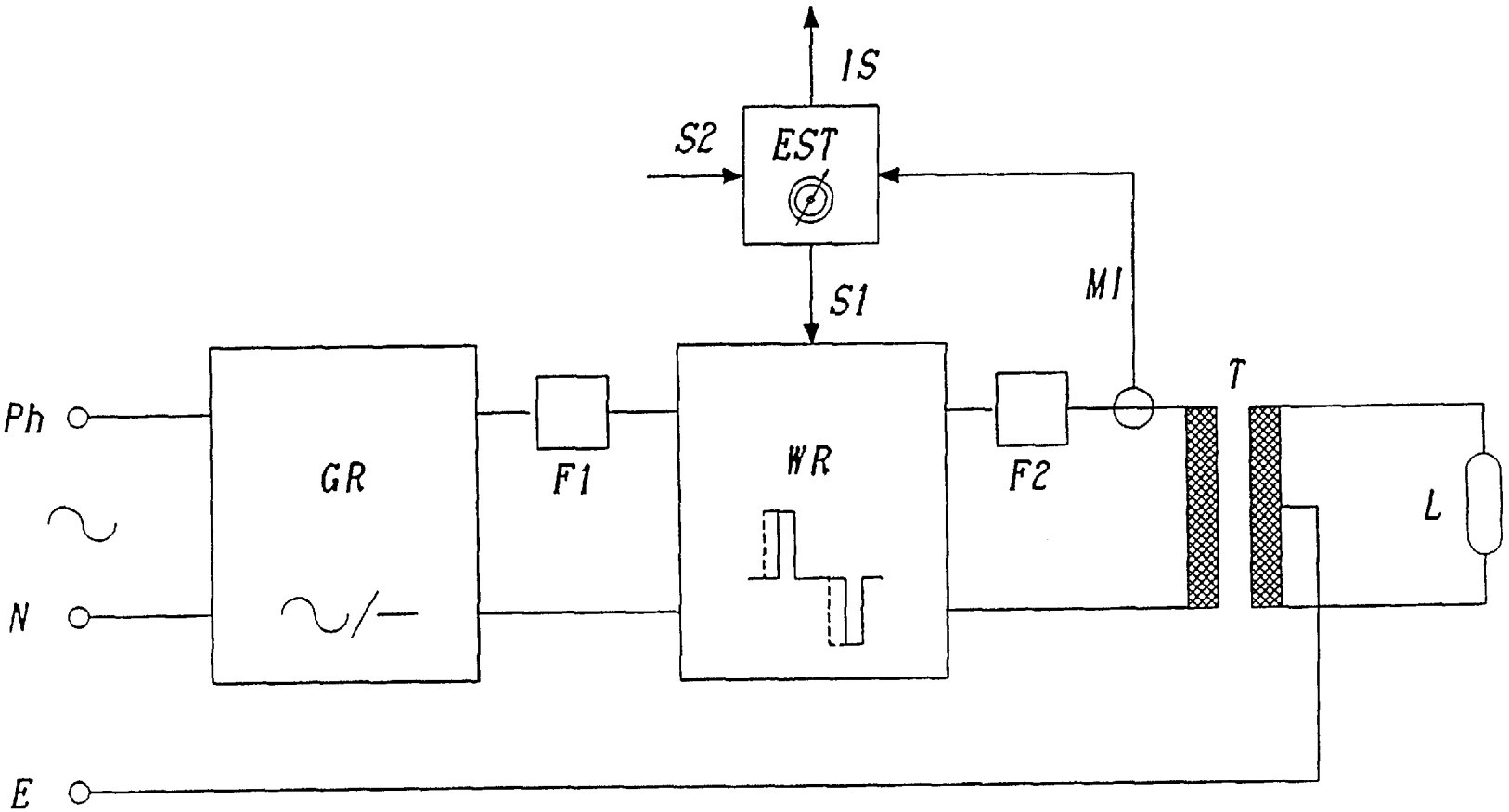

The present invention relates to a supply circuit for a fluorescent tube installation with a high voltage transformer.

STATE OF THE ART

Special transformers, so called neon transformers, are used for the operation of high voltage fluorescent tubes, particularly those for neon signs or display systems. They are constructed as stray field transformers i.e. with an air gap, so that they can both produce the high voltage necessary for ignition of the fluorescent tube, and also deliver the tube voltage necessary for long service life.

When referring to operational frequency, a distinction is made between low frequency installations, which run directly with the normal 50 or 60 Hz network frequency of the mains alternating voltage, and high frequency installations for frequencies from around 12,000 Hz upwards.

As the size of inductive parts decreases with frequency, it is possible to build high frequency installations that are considerably more compact and lighter than low frequency installations because of the transformer size. However, EMC problems (EMC stands for electromagnetic compatibility) occur with high frequency installations, since fluorescent tubes inevitably function as antennae. According to the regulations in force, this limits the installable efficacy with lasting effect. There are also restrictions as far as the connecting wires are concerned. Due to the EMC problem they have to be shielded. The resulting impedance limits wire length to about 10 m. Additional problems arise with certain wire lengths due to the formation of standing waves.

There are various reasons why no solutions exist for frequencies covering the range from low frequency areas above mains frequency up to the high frequencies mentioned. Among other reasons is the fact that losses at the air gap in the transformer and frequency connected physical consequences sharply increase. The physical problems become especially critical around 800 Hz. With increasing frequency the buzzing arising from the stray field transformer increasingly becomes a whistling. This whistling becomes particularly disturbing in the 1000 Hz range, since not only is a 1000 Hz tone found to be unpleasant, but the sensitivity of the human ear is at its greatest in this frequency range.

Neon installations are divided into different classes according to practical demands (above all regarding lighting efficacy and length of fluorescent tubes), and are classified with regard to voltage level and tube current. At present there are standards defined for 72 efficacy classes covering twelve different voltages between 750 V. and 15,000 V., each with eight values of current. A special transformer is used for each voltage and each current, optimised according to the construction size, weight and materials used.

Older models of transformer were sometimes equipped with an air gap regulator on the air gap so the transformer could be adjusted for use at different current levels. However, this type of transformer was considerably larger and heavier than types of transformer used at present and could not gain acceptance over non-adjustable models because of the extra cost.

DESCRIPTION OF THE INVENTION

The invention has the object of describing a supply circuit for a fluorescent tube with a high voltage transformer in the lower frequency range which can be made more simply, more economically and smaller than mains frequency installations commonly used at present, and where the mentioned wide variety of different types of transformers is reduced.

This object is achieved according to the invention by a supply circuit having the characteristics given in patent claim 1.

The circuit according to the invention is characterised in that, the transformer is connected on the primary side to an input voltage with a frequency of several hundred Hz, but is constructed without an air gap. An electronic control which emulates the current limiting function of an air gap is provided in the input circuit of the transformer to replace the air gap in the transformer.

As the input voltage has a frequency that is several hundred Hz greater than mains frequency, and which according to claim 2 is particularly between 300 and 800 Hz, preferably 400 Hz, the size and weight of the transformer can be substantially reduced.

The increase in transformer losses to be expected due to the frequency increase is avoided by the use of a transformer without an air gap, together with electronic emulation of the current limiting function of an air gap.

Additionally, the inevitable physical problems mentioned which occur from 800 Hz are avoided by the choice of a frequency in the given range, particularly by using a frequency of 400 Hz.

It is also particularly advantageous that the present multiplicity of neon transformer types can be considerably reduced through electronic current limitation or current regulation.

A factor in support of a frequency of 400 Hz is that suitable components are known in aircraft construction and can be more or less adopted for use from that source.

A further final advantage of using a transformer without an air gap is that transformers without air gaps do not produce a buzzing sound.

Preferred forms are described in the additional dependent claims.

SHORT EXPLANATION OF THE FIGURES

Figure 2:
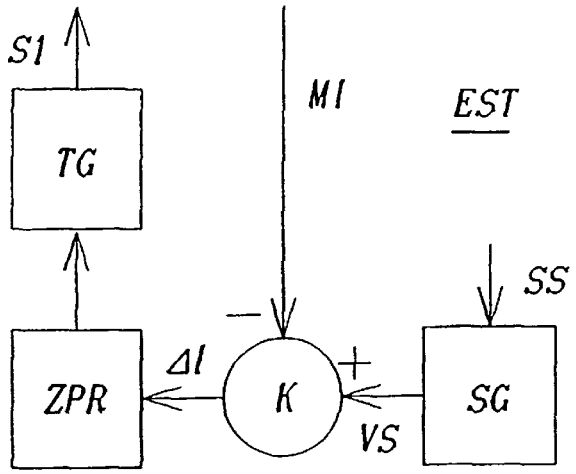

The invention will be described further by way of example in connection with the diagram. The figures are as follows:

FIG. 1 a general circuit diagram of a supply circuit according to the invention with a rectifier, an inverter and an electronic regulator;

FIG. 2 a form of the electronic regulator; and

Figure 3:
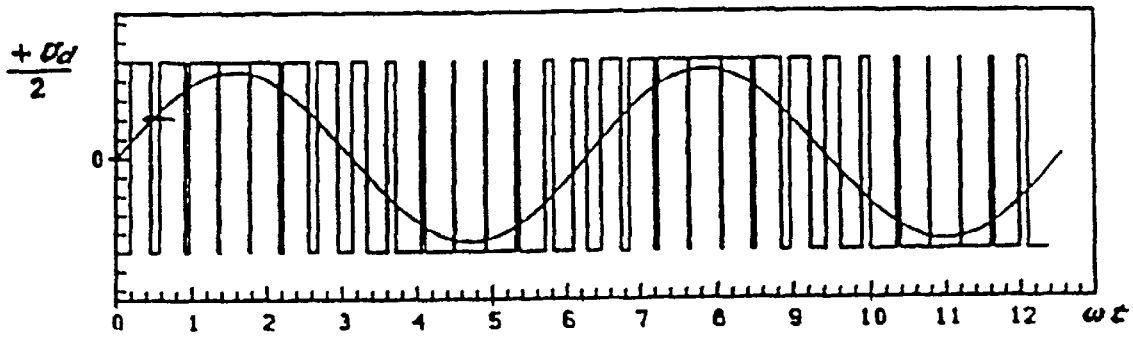

FIG. 3 a diagram of the voltage pulse sample preferably produced by the inverter.

MEANS OF CARRYING OUT THE INVENTION

In FIG. 1, Ph, N and E indicate the terminals for connecting to the live, neutral and the earth of a 50/60 Hz maiis alternating voltage supply of, for example, 220/230 V.

A rectifier circuit GR is connected to the terminals Ph and N, which produces direct voltage from the alternating voltage applied. The rectifier circuit GR cold be designed as, for example, an uncontrolled bridge circuit with four diodes.

In the subsequent inverter WR, an alternating voltage is again produced from the direct voltage, but it is a square wave voltage or a series of square wave signals, which can serve, after additional filtering, as input voltage for the subsequent transformer T. A frequency of 400 Hz for the input voltage is assumed in the following.

The inverter WR is furthermore designed in such a way that the width or duration of the square wave signal can be varied. This could, for example, be achieved by means of a bridge inverter circuit equipped with transistors. The current flow in the circuit can be regulated through control of the width of the square wave signal.

A filter F1 or F2 for smoothing or reducing harmonic components is preferably connected between the rectifier GR and the inverter WR as well as between the latter and the primary winding of the transformer T. The filter F2 also produces a useful oscillating circuit with the primary winding of the transformer T. The circuit's resonance frequency is determined by the frequency of the input voltage.

A fluorescent tube is connected or can be connected to the secondary or high voltage winding of the transformer T, but it is not itself part of the supply circuit. For safety reasons the high voltage winding of the transformer W is provided with midpoint earthing.

The transformer T is provided with a core without an air gap. To prevent short circuit-like behaviour at the moment of ignition, an electronic control EST is provided, which limits the current I in the circuit by acting on the inverter, and so almost emulates the current limiting function of the air gap of stray field transformers.

The electronic regulator EST is impinged on with a current measuring signal MI, which is preferably measured on the primary side. It could, of course, also be determined on the secondary side but the primary side connection is preferred due to the considerably higher voltage there. The electronic regulator EST produces a control signal S1 for the inverter WR from the measurement signal MI. The control signal S1 determines the aforementioned width of square wave signal for the inverter and hence the current flow in the circuit.

The transformer T is designed in such a way that it steps up the input voltage of e.g. 220/230 V produced by the inverter to a set high voltage in the range 750 V–15,000 V. On account of the higher frequency, the transformer T can be smaller and lighter compared to transformers designed for normal mains frequency. At 400 Hz this amounts to a factor of nearly 2.

The regulator EST is further designed so that independently or additionally to the regulation of current described above, the current level can be adjusted in steps, for example manually with a rotary switch. In this way, for each high voltage delivered by the transformer, the eight corresponding current levels can be produced in the high voltage circuit. For a high voltage of 1000 V the currents according to the present regulations would be 18 mA, 25 mA, 30 mA, 37 mA, 50 mA, 60 mA, 100 mA and 200 mA. The variety of different types of transformer is thus considerably reduced by having a regulated current.

It is an advantage to provide the EST regulator with at least one further input for a control signal S2, which, for example, can originate from protection devices for the recognition of malfunctions such as open circuit, short circuit, and/ or earthing. One or more further outputs could be fitted to the control, on which is provided an information signal indicating operating conditions. The electronic regulator as a whole, as well as the inputs and outputs mentioned, can be designed in analogue or digital form.

FIG. 2 shows a possible design for the electronic regulator EST, in which it is assumed that the inverter WR is constructed using a bridge inverter circuit equipped with transistors.

The electronic regulator EST includes a comparator K, a sine wave generator G, a two point regulator ZFR, and a dead time generator TG. The above-mentioned current measurement signal MI is supplied to one side of the comparator and to the other is supplied a comparison signal VS produced from the sine wave generator SG. The amplitude of the comparison signal is set as the target value of current for the sine wave generator, preferably in steps, corresponding to the standard current levels given above.

The output ΔI of the comparator K impinges on the two point regulator ZFR, whose output signal forms the above-mentioned control signal S1 for the inverter WR, once it has passed through the dead time generator TG. The two point regulator ZFR connects the inverter WR within preset tolerance limits e.g. to the positive output if the measurement signal IM corresponding to the obtained value is smaller than the comparison signal VS corresponding to the target value, and to the negative output if the measurement signal IM corresponding to the obtained value is greater than the comparison signal VS corresponding to the target value. The dead time generator TG simply ensures that only the pair of transistors that belong together will always be controlled in the inverter WR and thus short circuits in the inverter will be avoided.

FIG. 3 again shows the voltage pulse sample preferably produced by the inverter WR in response to the control signal SI. This does not directly indicate the desired frequency of the input voltage of e.g. 400 Hz but a considerably higher value of e.g. 10000 Hz. The frequency of the input voltage to be produced is shifted to high frequency however and can be produced from it by averaging. The relevant averaging occurs, for example, by means of the above-mentioned filter F2, which is also shown in FIG. 1. It is a short duration averaging since long duration averaging would have to disappear over the voltage pulse sample shown, otherwise a direct current would flow in the primary circuit of the transformer T.

What is claimed is:

1. A supply circuit for a fluorescent tube installation with a high frequency transformer, characterized in that, the transformer (T) is constructed without an air gap and is connected on its primary side to an input voltage with a frequency of several hundred Hz, that an electronic regulator (EST) which emulates the current limiting finction of an air gap is provided in an input circuit as a replacement for an air gap in the transformer.

2. A supply circuit according to claim 1, characterized in that the frequency of the input voltage is 300–800 Hz, preferably 400 Hz.

3. A supply circuit according to either claim 1 or claim 2, characterized in that the input voltage is produced from mains alternating voltage (Ph, N, E) by rectifying with a rectifier (GR) and by subsequent conversion back to alternating voltage with an inverter (WR).

4. A supply circuit according to claim 3, characterized in that the inverter (WR) produces a sine waveform modulated square wave voltage or a sine waveform modulated series of square wave signals.

5. A supply circuit according to claim 4, characterized in that the inverter (WR) permits control of the width or duration of the square wave signal.

6. A supply circuit according to claim 5, characterized in that the width or duration of the square wave signal depends on a control signal (S1), which is derived through the electronic regulator (EST) from a current measurement signal (MI).

7. A supply circuit according to claim 6, characterized in that the current measurement signal (MI) is produced on the primary side of the transformer (T).

8. A supply circuit according to claim 7, characterized in that a filter (F2) is connected between the inverter (WR) and the primary winding of the transformer (T) in order to reduce harmonic components connected to the frequency of the input voltage, and which creates an oscillating circuit with the primary winding.

9. A supply circuit according to claim 8, characterized in that the resonance frequency of the oscillating circuit is determined by the frequency of the input voltage.

* * * * *